United States Patent [19]

Torbett

[11] Patent Number: 4,730,702

[45] Date of Patent: Mar. 15, 1988

[54] TREE-CLIMBING APPARATUS

[76] Inventor: Vernon A. Torbett, P.O. Box 33, Culp Creek, Oreg. 97427

[21] Appl. No.: 81,364

[22] Filed: Aug. 4, 1987

[51] Int. Cl.[4] ..... A63B 27/00

[52] U.S. Cl. ..... 182/221; 182/134

[58] Field of Search ..... 182/221, 134, 135, 136

[56] References Cited

U.S. PATENT DOCUMENTS

| | | | |
|---|---|---|---|
| 1,983,526 | 12/1934 | Bailey | 182/221 |
| 2,016,249 | 10/1935 | Bashlin | 182/221 |
| 2,297,136 | 9/1942 | Detering | 182/221 |
| 2,391,810 | 12/1945 | Webber | 182/221 |
| 2,484,389 | 10/1949 | Schatz | 182/221 |
| 2,519,589 | 8/1950 | Miller | 182/221 |
| 2,570,001 | 10/1951 | McCammond | 182/221 |
| 2,604,250 | 7/1952 | Trimble | 182/221 |
| 2,835,426 | 5/1958 | Terry | 182/221 |
| 3,025,927 | 3/1962 | Stein | 182/221 |
| 4,524,530 | 6/1985 | Greenway | 182/221 |
| 4,574,919 | 3/1986 | Clay | 182/221 |

*Primary Examiner*—Reinaldo P. Machado
*Attorney, Agent, or Firm*—Richard C. Litman

[57] ABSTRACT

Tree or pole climbing apparatus includes a spike member for gripping a tree to facilitate climbing which is easily removed from the tree by rotating or rocking the foot back and forth. U-shaped front and rear boot support members are connected by laterally spaced apart parallel members that include boot wrapping material while a vertical member disposed adjacent the rear boot support member includes leg wrapping material. During climbing, the vertical member provides one's leg with improved comfort while firmly stabilizing the apparatus.

7 Claims, 3 Drawing Figures

TREE-CLIMBING APPARATUS

BACKGROUND OF THE INVENTION

This invention relates to improvements in tree or pole climbing apparatus. For example, in wilderness areas many sportsmen may have to climb trees which may not have any low-hanging branches. Such individuals have use for apparatus that can be attached to or fit over their shoes, boots, or the like, and that are provided with spike members for gripping the trunk of the tree to facilitate climbing. Most of the similar climbing apparatus previously constructed have certain disadvantages because they create outwardly directed pressure against the legs, causing them to fatigue rapidly and painfully. The present invention can be worn in its environment for extended periods of time without causing pain to the user.

The method of construction of the device is more fully described herein.

DESCRIPTION OF THE PRIOR ART

Prior art relating to the field of the invention includes the following U.S. patents:

| Inventor | U.S. Pat. No. |
|---|---|
| M. D. Clay | 4,574,919 |
| P. R. Greenway | 4,524,530 |
| J. M. Stein | 3,025,927 |
| R. A. Terry | 2,835,426 |
| J. A. Trimble | 2,604,250 |
| W. D. McCammond | 2,570,001 |
| R. J. Miller | 2,519,589 |
| T. T. Munger | 2,484,181 |
| H. R. Webber | 2,391,810 |
| H. T. Detering | 2,297,136 |
| W. M. Bashlin | 2,016,249 |
| G. M. Howard | 596,113 |

U.S. Pat. No. 4,524,530 issued to Greenway discloses a one-piece, molded-plastic, outer boot with a replaceable steel gaff on the exterior of the boot rigidly fastened through said outer boot to a reinforcing plate embedded within an inside wall portion of said outer boot.

All the other U.S. patents listed above (U.S. Pat. Nos. 4,574,919; 3,025,927; 2,835,426; 2,604,250; 2,570,001; 2,519,589; 2,484,181; 2,391,810, 2,297,136; 2,016,249; and 596,113) contain disclosures of generally L-shaped leg support members with a sharp spur attached immediately to the long vertical side of the generally L-shaped leg support structure. These apparatuses differ among themselves in having certain features providing various advantages such as a hinge added to facilitate collapse for transport or storage, mechanisms for rendering the spur detachable and attachable, a spring for further supporting the weight of the climber, additional spurs, adjustable positioners for the leg straps, various forms of boat structures, and various angles of attack and geometry of the spur member.

However, none of the aforesaid devices resemble the present invention in its principle feature; namely, having the climbing spur attached to the horizontal base portion of the L-shaped leg support member; nor do the inventions of the prior art resemble the present invention in its unique structure wherein which two rigid cross-members support the boot or shoe from below and a curved rigid member passes around the back portion of the boot or shoe, above the top of the heel.

SUMMARY OF THE INVENTION

An object of the invention is to provide an apparatus that is safe and lends itself to tree climbing and the like.

Another object of the invention is directed further to apparatus which is easily fitted on the legs and feet.

Another object of the invention is to provide a novel and improved construction of climbing apparatus whereby it may be used in its environment for extended periods of time, without causing pain and fatigue to a user's legs.

These, together with other objects and advantages of the invention, reside in the details of the process and the operation thereof, as is more fully hereinafter described and claimed. Reference is made to the drawing forming a part hereof, wherein like numerals refer to like parts throughout.

DESCRIPTION OF THE PREFERRED EMBODIMENT

Figure 3:
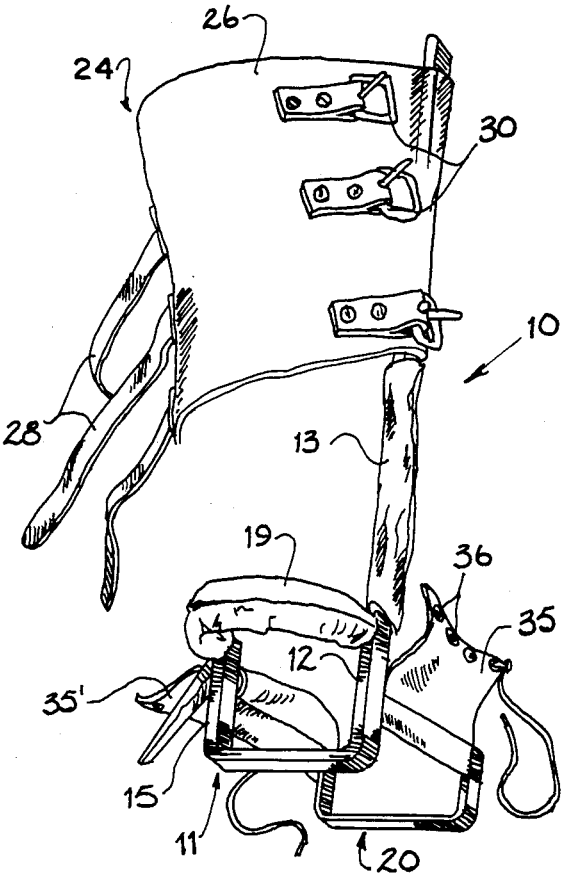
FIG. 3 is a rear perspective view.
Figure 1:
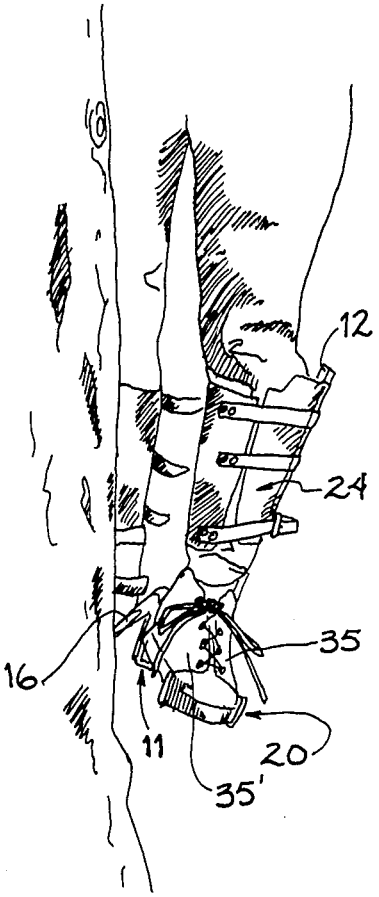
FIG. 1 is a front view of the device of the invention.
Figure 2:
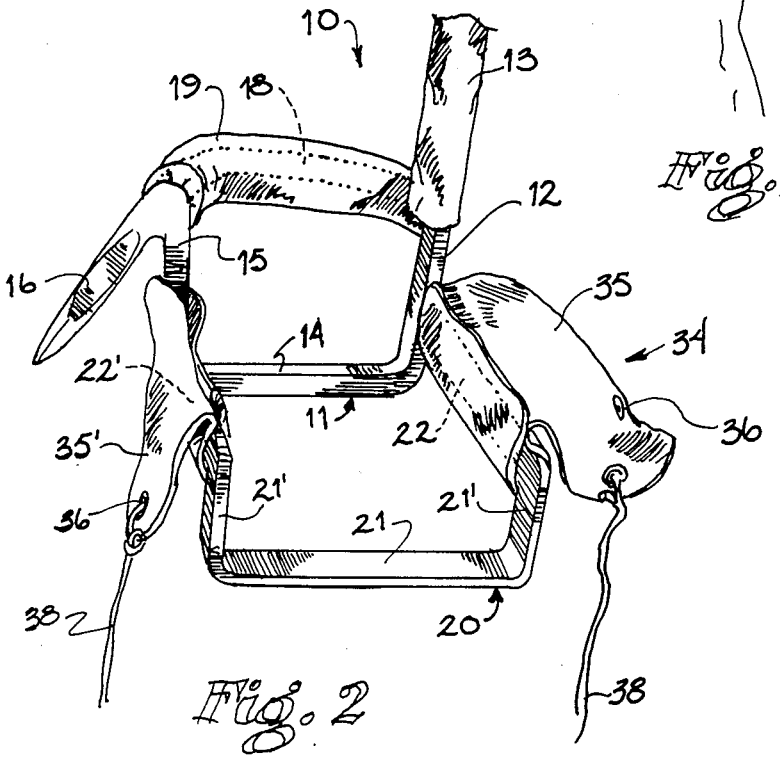
FIG. 2 is an enlarged, partial front view of the device of FIG. 1.

Referring now to the drawing, FIGS. 1 and 2 illustrate a tree or pole climbing apparatus 10 for a user's left foot, while FIG. 3 shows a mirror image version as provided for the right foot. Each includes a frame made of rigid metal comprising, a rear-boot support means 11 having vertical member 12 disposed at right angles to a horizontal bottom member 14 so that it is exteriorly adjacent to a user's leg. The vertical leg member 12 is wrapped with cusion means 13 to protect the lower outer leg immediately above an arcuate rear member 18. A spike 16, angularly extends downwardly and outwardly from the top of a vertical, inside brace 15 which is joined to the bottom member 14 opposite the vertical member 12. The length of the spike 16 may be varied according to the environment being encountered. For example, shorter spikes would be more appropriate when climbing poles without bark.

The arcuate member 18, which includes a cushion member 19 thereon to protect a users lower rear leg just above the heel, is disposed about the rear of the rear boot support means 11 immediately below the cushion means 13 to eliminate backward slippage of the user's shoe or boot. Front boot support means 20 comprises a U-shaped member having a base 21 joined to two uprights 21'—21' and is attached to the rear boot support means by two laterally spaced apart parallel side members 22–22'. Leg wrapping means 24, comprising a sheet 26 of pliable material is attached to the upper portion of the vertical member 12 and includes fastening means comprising a plurality of belts 28 and buckles 30 oppositely attached to the sheet material 26. Boot wrapping means 34 comprising two separate strips 35–35' of pliable material, are respectively attached to the parallel members 22–22' and each include a plurality of eyelets 36 and a lace 38 that provide a means to draw the pliable strips 35–35' together, such as shown in FIG. 1.

A climber would use the invention by fitting the right and left tree climbing apparatus 10 on the corresponding legs over whatever shoes or boots being worn and then would fasten the leg wrapping means 24 and the boot wrapping means 34. The climber would then approach the tree to be climbed and begin by driving the spike 16 of one apparatus into the tree at a convenient height, followed by driving the spike of the alternate apparatus higher on the tree. These stages are repeated until the desired height is attained. In descending the climber would reverse this procedure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents, which may be resorted to, fall within the scope of the invention.

What is claimed is:

1. An apparatus for climbing trees and the like, comprising: a rigid frame including:

rear boot support means;

means adjacent said rear boot support means for preventing rearward slippage of a user's boot and having a cushion disposed thereon;

an extended vertical member attached to said rear boot support means;

leg wrapping means carried by said vertical member to support the leg relative said frame;

means for cushioning a user's leg carried by said vertical member;

a spike angularly extending downwardly from said rear boot support means opposite said vertical member;

front boot support means; and two laterally spaced apart parallel members having boot wrapping means and provided with opposite ends connected to said rear boot support means and said front boot support means.

2. The apparatus of claim 1, wherein the material of said front and rear support means, spike, laterally spaced members, and vertical member is metal.

3. The apparatus of claim 1, wherein said rear boot support means is of shallow U-shape.

4. The apparatus of claim 1, wherein said leg wrapping means comprises pliable material including a plurality of belts and buckles and is disposed on the upper portion of said vertical member.

5. The apparatus of claim 1, wherein said cushioning means is elongated.

6. The apparatus of claim 1, wherein said front boot support means is of shallow U-shape.

7. The apparatus of claim 1, wherein said boot wrapping means comprises two pieces of pliable material each having a plurality of eyelets and a lace.

* * * * *